United States Patent [19]

Wang

[11] 4,409,805

[45] Oct. 18, 1983

[54] KEY OPERATED LOCK

[76] Inventor: Tzu-Cheng Wang, 4th Floor, 117 Fu-Kong St., Shilin, Taipei, Taiwan

[21] Appl. No.: 343,449

[22] Filed: Jan. 28, 1982

[51] Int. Cl.[3] ..... E05B 67/36

[52] U.S. Cl. ..... 70/32

[58] Field of Search ..... 70/32, 33, 34, 25, 26, 70/38 R, 38 A, 38 B, 38 C, 39

[56] References Cited

U.S. PATENT DOCUMENTS

| | | | |
|---|---|---|---|
| 1,592,696 | 7/1926 | Heyer | 70/34 |
| 2,660,872 | 12/1953 | Beach | 70/32 |
| 4,236,395 | 12/1980 | Avaiusini | 70/34 |
| 4,269,048 | 5/1981 | McDorman | 70/34 |

FOREIGN PATENT DOCUMENTS

| | | | |
|---|---|---|---|
| 255889 | 1/1913 | Fed. Rep. of Germany | 70/34 |
| 2425386 | 12/1975 | Fed. Rep. of Germany | 70/34 |
| 284201 | 4/1931 | Italy | 70/34 |

*Primary Examiner*—Robert L. Wolfe

*Attorney, Agent, or Firm*—Kirschstein, Kirschstein, Ottinger & Cobrin

[57] ABSTRACT

A key operated lock comprises, a lock body; a retractable lock bar with a bevel head, operable by an external pressure, disposed in the body; two locking plates abutted one another in the body and biassed by two separate springs parallelly and opposite to one another, each of the locking plates having an opening adjacent to one another, the openings jointly forming a throughhole for gripping the bevel head to place the lock in its locking position. The throughhole which is in its releasing position is a full circular shape that can allow the bevel head to pass therethrough and is of the shape formed of two dislocated semicircles in its gripping position. The release means for the retractable lock bar includes two cam members which will move, by key operation, the locking plates against the biassing action of the springs to make the throughhole vary to its releasing position so that the lock bar will be released.

5 Claims, 3 Drawing Figures

KEY OPERATED LOCK

BACKGROUND OF THE INVENTION

This invention relates to a key operated lock designed to be hanged on doors, cases or the like.

Common key operated lock usually have a retractable lock arm having a notch at the end thereof. The lock arm, in its retracted position, is gripped by the engagement of the notch and a spring biassed latch pin inside the lock body when the lock is in its locking position. By key operation the latch pin is retracted and therefore the lock arm is released, thereby placing the lock in a released position. In such locks, the locking action is only performed by a spring biassing in a single direction and therefore it is easy to release that locking action by using a thin plate or small pin to depress the spring against its biassing action.

SUMMARY OF THE INVNETION

According to the invention, a key operated lock comprises a lock body; a retractable lock bar, operable by an external pressure, disposed in the body and having a head portion; two locking plates abutted one another in the body and biassed by two separate springs parallelly and opposite to one another, each of the locking plates having an opening adjacent to one another, the openings jointly forming a throughhole for gripping the head portion to place the lock in its locking position, the shape of the throughhole being variable upon movement of the locking plates between a gripping position and releasing position; a key operated release means provided on the locking plates for moving said locking plates against the biassing action of the springs to make the throughhole vary to its releasing position so that the lock bar is released.

Preferably, the head portion of the lock bar is a bevel head. In an aspect of the invention the throughhole which is in its releasing position has a full circular shape that can allow the bevel head to pass therethrough and is of the shape formed of two dislocated semicircles in its gripping position.

In another aspect of the invntion, the lock bar is biased outwardly of the lock body and retractable against the action of the bias when subjected to a pressure, the retracted lock bar being gripped by the throughhole which is in its gripping position.

In further aspect of the invention, the release means comprises two cam members separately secured at the locking plates and pivotaly supported in the body, the cam member actuated by an operating key of the lock being capable of moving locking plates against the biassing action of the springs.

The lock body of the invention can be constructed to a form which has a recess at the outer part of the body to cover around the door fastener to which the lock is attached.

The object of the invention is to provide an improved key operated lock having a retractable lock bar with a bevel head which will be grasped by a variable shape throughhole jointly possessed by two locking plates biassed parallelly and opposite to one another. The lock bar thereof can be released by the key actuated cam actions.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 2:
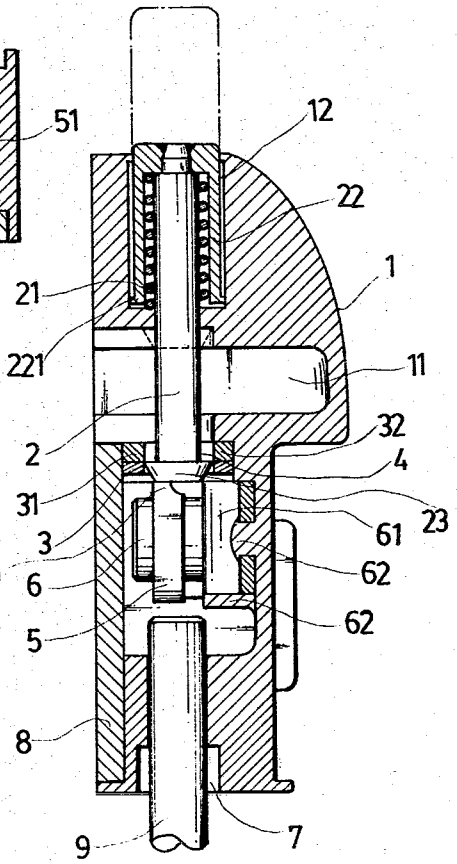
FIG. 2 is a sectional side view of a lock according to the invention.
Figure 1:
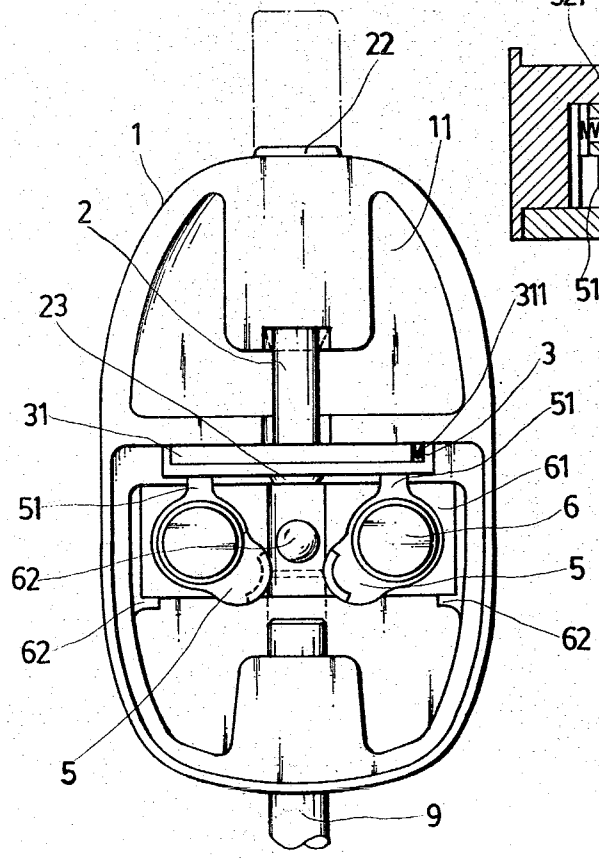
FIG. 1 is a sectional rear view illustrating a lock according to the invention with its rear cover plate taken therefrom.

As shown in FIGS. 1 & 2, a lock according to the invention comprises a retractable lock bar 2 which has a bevel head 23 disposed in a lock body 1. The lock body has a recess 11 through which the lock bar passes provided in the outer part of the lock body 1. By means of the recess 11 the lock body 1 can cover around the door fastener to which the lock is attached. The lock bar 2 is disposed in a casing 22 and sleeved with a spring 21. The casing 22 is movably mounted in a recess 12 of the lock body 1 and has a flange portion 221 which will be gripped by the lock body 1 at the end of the movement thereof. The lock bar 2 is biassed outwardly of the lock body 1 by the spring 21 when the lock is in its releasing position and is retractable when subjected to an external pressure for locking.

Figure 3:
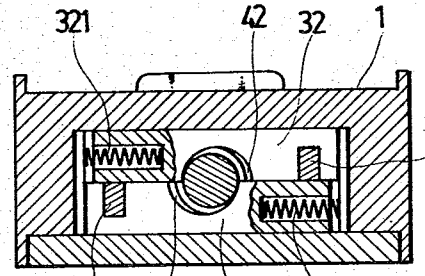
FIG. 3 is a sectional view taken along the line A—A of FIG. 1.

On the other side of the recess 12, where the retracted lock bar 2 will reach, is a support casing 3 mounted in the lock body 1 and it is carrying two movable locking plates 31 and 32 being abutted one another, as shown in FIG. 3. The locking plates 31 and 32 are provided with two separate springs 311 and 321 which are biassing parallelly and opposite to one another. The locking plates 31 and 32 respectively have two semi-circular openings 41 and 42 which jointly forms a variable shape throughhole 4 for gripping the bevel head 23 when the lock bar 2 is retracted. With the movement of the locking plates 31 and 32 the shape of the throughhole 4 varies between its gripping position and releasing position. In the gripping position the throughholes 4 has a full circular shape formed of semi-circular openings 41 and 42, and in the releasing position the throughhole 4 has a shape formed of two dislocated semicircular openings 41 and 42. The latter shape can grip the bevel head 23 which passes therethrough.

Under the locking plates 41 and 42, two cam members 5 are pivotably supported by two separate cylindrical protrusions 6 which are integrally formed on a base plate 61 mounted in the lock body 1 by engagement with protrusions 62. The two cam members 5 are separately secured at the locking plates 31 and 32 by means of its extended portions 51 inserted into the plates 31 and 32. A key hole 7 is provided in the lower portion of the lock body 1, and a rear plate 8 is covering the rear side of the lock body.

When the lock bar 2 is depressed into the lock body, it will pass through the recess 11 and thrust into the throughhole 4 which will grip it thereat. When a key 9 of the lock is inserted into the key hole, the key will act on the cam members 5 to rotate, and this motion will be transmitted to the plates 31 and 32 to move them against the biassing action of the springs 311 and 321. As the result, the semi-circular openings 41 and 42 coincides, thus forming a full circular throughhole to allow the bevel head 23 passing therethrough. As soon as the bevel head 23 is released the lock bar 2 is protruded outward again, thereby placing the lock in its releasing position.

With the invention thus explained, it is apparent that obvious modifications and variations can be made without departing from the scope of the invention. It is therefore intended that the invention be limited only as indicated in the appended claims.

What I claim is:

1. A key operated lock comprising, a lock body; a retractable lock bar, operable by an external pressure, disposed in said body having a head portion; two locking plates abutted one another in said body and biassd by two separate springs parallelly and opposite to one another, each of said locking plates having an opening adjacent to one another, said openings jointly forming a throughhole for gripping said head portion to place the lock in its locking position, the shape of said throughhole being variable upon movement of said locking plates between a gripping position and releasing position; a key operated release means provided on said locking plates for moving said locking plates against the biassing action of said springs to make said throughhole vary to its releasing position so that the lock bar is released.

2. A key operated lock as claimed in claim 1, wherein said retractable lock bar has a bevel head.

3. A key operated lock as claimed in claim 2, wherein said throughhole which is in its releasing position is a full circular shape that can allow said bevel head to pass therethrough, and is of the shape formed of two dislocated semicircles in its gripping position.

4. A key operated lock as claimed in claim 3, wherein said retractable lock bar is biassed outwardly of said lock body and retractable against the action of said bias when subjected to a pressure, said retractable lock bar substantially disposed at the center line of said lock body.

5. A key operated lock as claimed in claim 4, wherein said release means comprises two cam members separately secured at said locking plates and pivotably supported in said body, the cam members actuated by an operating key being capable of moving said locking plates against the biassing action of said springs.

* * * * *